US011273976B2

(12) United States Patent
Thurston et al.

(10) Patent No.: US 11,273,976 B2
(45) Date of Patent: Mar. 15, 2022

(54) WATER STORAGE LID

(71) Applicant: Asset Guard Products Inc., Houston, TX (US)

(72) Inventors: Richard Thurston, Argyle, TX (US); Richard Davis, Roanoke, TX (US)

(73) Assignee: Asset Guard Products Inc., Houston, TX (US)

( * ) Notice: Subject to any disclaimer, the term of this patent is extended or adjusted under 35 U.S.C. 154(b) by 0 days.

(21) Appl. No.: 16/289,696

(22) Filed: Mar. 1, 2019

(65) Prior Publication Data

US 2019/0270583 A1 Sep. 5, 2019

Related U.S. Application Data

(60) Provisional application No. 62/637,801, filed on Mar. 2, 2018.

(51) Int. Cl.
*B65D 88/36* (2006.01)
*B65D 88/34* (2006.01)

(52) U.S. Cl.
CPC ..... *B65D 88/34* (2013.01)

(58) Field of Classification Search
CPC ..... B65F 88/34; B65D 88/34; B65D 88/36; B65D 90/42
USPC ..... 220/216, 218, 219, 578
See application file for complete search history.

(56) References Cited

U.S. PATENT DOCUMENTS 4,213,280 A * 7/1980 Sandborn ..... B65D 88/36 220/218
9,434,534 B2 9/2016 Whitener
2015/0284924 A1* 10/2015 Whitener ..... B65D 88/34 220/216

OTHER PUBLICATIONS

Canadian Office Action dated Jun. 8, 2020 for Application No. 3,035,367.
Canadian Office Action dated Mar. 1, 2021 for Application No. 3,035,367.

* cited by examiner

*Primary Examiner* — Don M Anderson
*Assistant Examiner* — Elizabeth J Volz
(74) *Attorney, Agent, or Firm* — Patterson + Sheridan, LLP

(57) ABSTRACT

Tank lids include a first coated substrate including a first part having a first thickness, a first elastomer coating the first part, a second coated substrate positioned adjacent to the first coated substrate, the second coated substrate including a second part having a second thickness, and a second elastomer coating the second part. A first seam can be formed between the first and second coated substrates to allow for moisture to pass between the first and second coated substrates so that moisture is allowed to seep away from the top of the tank lid.

20 Claims, 5 Drawing Sheets

WATER STORAGE LID

CROSS REFERENCE TO RELATED APPLICATIONS

This application claims the benefit of U.S. Provisional Patent Application No. 62/637,801, filed on Mar. 2, 2018, which is incorporated herein by reference in its entirety.

TECHNICAL FIELD

The present disclosure relates to a floating water storage lid. In particular, the present disclosure provides an encapsulated foam material that can float on a surface of water stored in an open container, thereby serving as a cover or lid for the water in the container.

BACKGROUND

Water is oftentimes stored in several types of open-top containers, or water containments, used on or near well sites and the like. These water containments can be subjected to temperature extremes, such as freezing or excessive heat that can freeze or evaporate, respectively, the water contained therein. Temporary coverings have been used in an attempt to prevent freezing or evaporation of the water. Existing coverings, however, lack the insulative properties needed to prevent freezing or evaporation and/or are oftentimes difficult to install in the field.

A need exists for a way to protect water contained in an open-top containment during inclement weather conditions. There is also a need for a water containment cover that can be quickly and easily installed on a well site location and with a minimum number of personnel.

BRIEF DESCRIPTION OF THE DRAWINGS

The accompanying drawings facilitate an understanding of the various exemplary embodiments.

DETAILED DESCRIPTION

Figure 1:
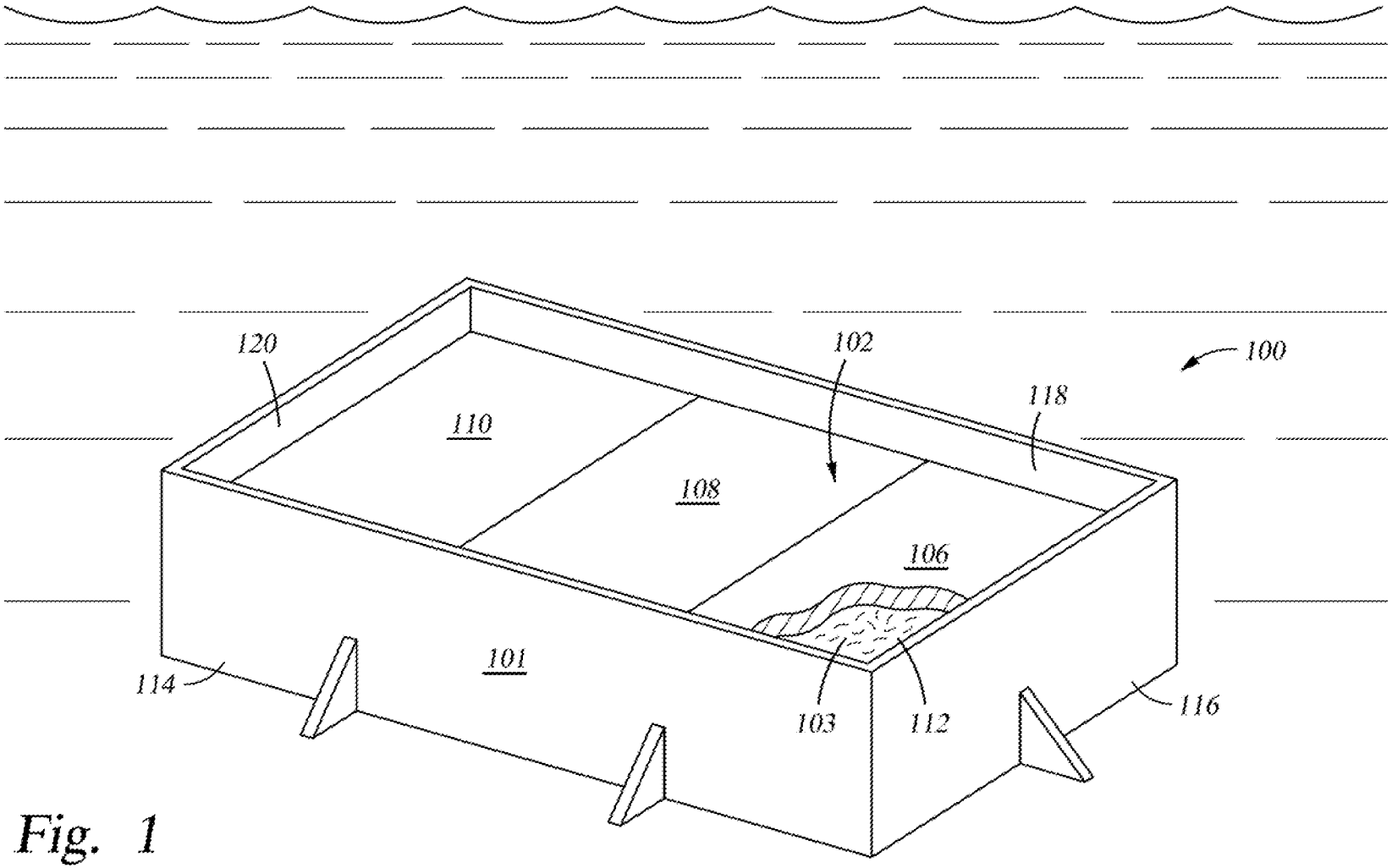
FIG. 1 is a perspective view of a system having a tank lid, according to an exemplary embodiment.

In an exemplary embodiment, as illustrated in FIG. 1, a system is generally referred to by the reference numeral 100 and includes a water tank 101 that extends over the ground surface. The water tank 101 is shown, via a cutaway section, containing a volume of water 103 having an upper surface, or water surface 112. The water tank 101 can have a bottom (not shown) and a plurality of sides (four are shown, 114, 116, 118, 120) extending upward or vertically from the bottom to form an interior space for containing the volume of water. As shown in FIG. 1, a tank lid 102 having a plurality of segments 106, 108, 110 can cover at least a portion of the water surface 112. The segments 106, 108, 110 can be contained within the sides 114, 116, 118, 120 of the water tank 101.

Figure 2:
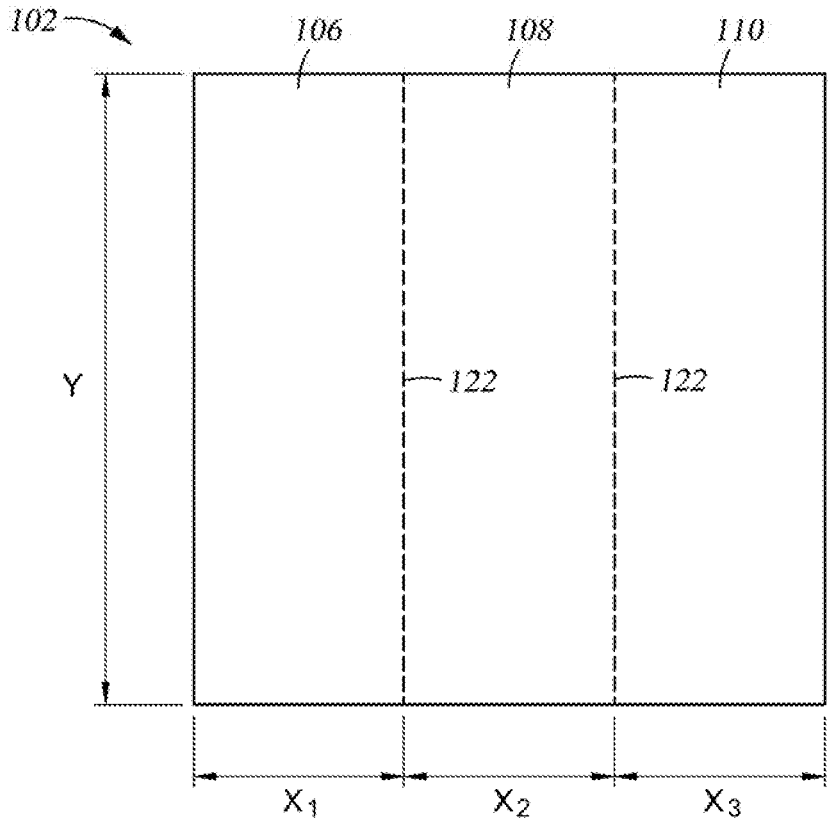
FIG. 2 is a top view of the tank lid of FIG. 1.

FIG. 2 is a top view of the tank lid 102 of FIG. 1. The tank lid 102 can be a single piece, or segment, or can include two or more segments. As shown in FIG. 2, the tank lid 102 contains a first segment 106, a second segment 108, and a third segment 110. The segments 106, 108, 110 can have any suitable dimensions. As shown in FIG. 2, the segments 106, 108, 110 can each have a length y and a width ($x_1$, $x_2$, or $x_3$). The length y and width $x_1$, $x_2$, or $x_3$ can vary to any suitable measurements depending on the equipment unit or units to be supported. In one or more exemplary embodiments, $x_1$, $x_2$, and $x_3$ can be independently from about 10 cm to about 10 m, such as from about 25 cm to about 5 m, such as from about 50 cm to about 3 m, such as from about 1 m to about 2 m and y can be from about 50 cm to about 50 m, such as from about 1 m to about 25 m, such as from about 2 m to about 15 m, such as from about 3 m to about 10 m.

The segments 106, 108, 110 can be or include any suitable substrate. As used herein, the term "suitable substrate" is used synonymously with "substrate" and is meant to include without limitation, concrete, metal, polymeric solids, polymeric foams, such as expanded polystyrene (EPS) and expanded polyurethane, wood, paper fiber, fiberglass, fiber board, and gravel or any other substrate appropriate for the adhesion of an elastomeric coating, such as a polyurea elastomer coating. In one or more embodiments, a substrate includes one or more foam materials such as EPS, polyisocyanurate foams, polyurethane foam, polyvinyl chloride foam, polyimide foam, silicone foam, or microcellular foam or any suitable combinations thereof. The foam material can have any suitable density. For example, the foam material can have a density of about 0.5 pounds per square foot ($lb/ft^3$) to about 8 $lb/ft^3$ or more, such as from about 1 $lb/ft^3$ to about 5 $lb/ft^3$, such as from about 1.5 $lb/ft^3$ to about 3 $lb/ft^3$, such as from about 2 $lb/ft^3$ to about 2.5 $lb/ft^3$. In one or more exemplary embodiments, the foam material has a density from about 1.5 $lb/ft^3$ to about 2.5 $lb/ft^3$. The foam material can be substantially non-degradable or substantially degradable. In one or more exemplary embodiments, the foam material is biodegradable.

The substrate can have any suitable thickness. In one or more exemplary embodiments, the substrate can have a thickness of from about 0.5 inch to about 12 inches or more, such as from about 1 inch to about 8 inches, such as from about 2 inches to about 6 inches, such as from about 3 inches to about 5 inches, for example about 4 inches. For example, a piece of equipment weighing approximately 50,000 pounds can be supported by EPS having a foam density of 2 pounds per cubic foot of foam weight, ranging from about 3 to about 12 inches in thickness.

The segments 106, 108, 110 can also include an elastomeric outer coating or layer. In one or more exemplary embodiments, the segments 106, 108, 110 are each encapsulated with the elastomeric layer. The elastomeric layer can be or include any polymeric material that can both create a fluid impermeable barrier layer and adhere directly to and/or at least partially penetrate the foam material of the segments 106, 108, 110. In one or more embodiments, the polymeric material can be or include polyurea. The elastomeric coating can have any suitable thickness. In one or more exemplary embodiments, the elastomeric coating of the liner 104 can have a thickness about 5 mil, about 10 mil, about 15 mil, 20 mil, about 30 mil, about 40 mil to about 50 mil or more.

The tank lid 102 and its segments 106, 108, 110 can provide an insulative barrier that can prevent or substantially eliminate evaporation and/or freezing of the water covered by the tank lid 102. In one or more exemplary embodiment, the tank lid 102 can have an R-Value, measured in accordance with ASTM C518, of from about 2° $Fft^2h/Btu$ to about 10° $Fft^2h/Btu$, such as from about 2.5° $Fft^2h/Btu$ to about 8° $Fft^2h/Btu$, such as from about 3° $Fft^2h/Btu$ to about 6° $Fft^2h/Btu$, such as from about 3.5° $Fft^2h/Btu$ to about 5° $Fft^2h/Btu$, for example about 4.5° $Fft^2h/Btu$.

The segments 106, 108, 110 can also have any suitable thickness. In one or more exemplary embodiments, the segments 106, 108, 110 can have a thickness of from about 0.5 inch to about 12 inches, such as from about 1 inch to about 8 inches, such as from about 2 inches to about 6 inches, such as from about 3 inches to about 5 inches, for example 4 inches.

The segments 106, 108, 110 can form one or more seams 122 (four are shown) when positioned adjacent one another to form the tank lid 102. These seams can allow for moisture, such as rainwater, to pass between and through the segments and into the water contained below the tank lid 102, thereby preventing rainwater from pooling or collecting on the upper surface of the tank lid 102.

Figure 3:
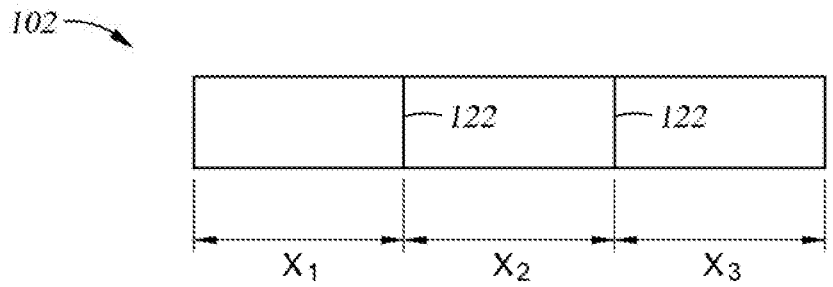
FIG. 3 is a side view of the tank lid of FIG. 1.
Figure 4:
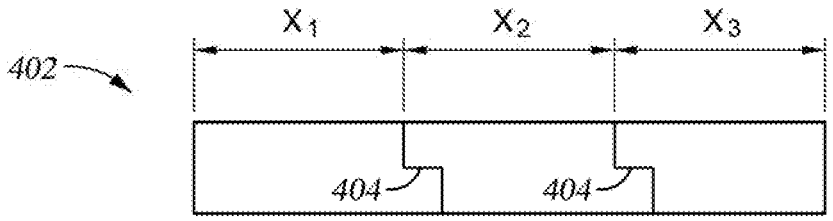
FIG. 4 is a side view of another tank lid, according to an exemplary embodiment.

FIG. 3 illustrates a side view of the tank lid 102 showing seams 122. The seams 122 depicted in FIG. 3 are straight and allow for any moisture from rainwater, for example, to pass through so as to prevent pooling of water on top of the tank lid 102. FIG. 4 illustrates a side view of a tank lid 402 having interlocking seams 404. The interlocking seams 404 shown in FIG. 4 allow for moisture to seep away from the top of the tank lid 402, but also allow for another embodiment in which to piece or hold together the segments.

Figure 5:
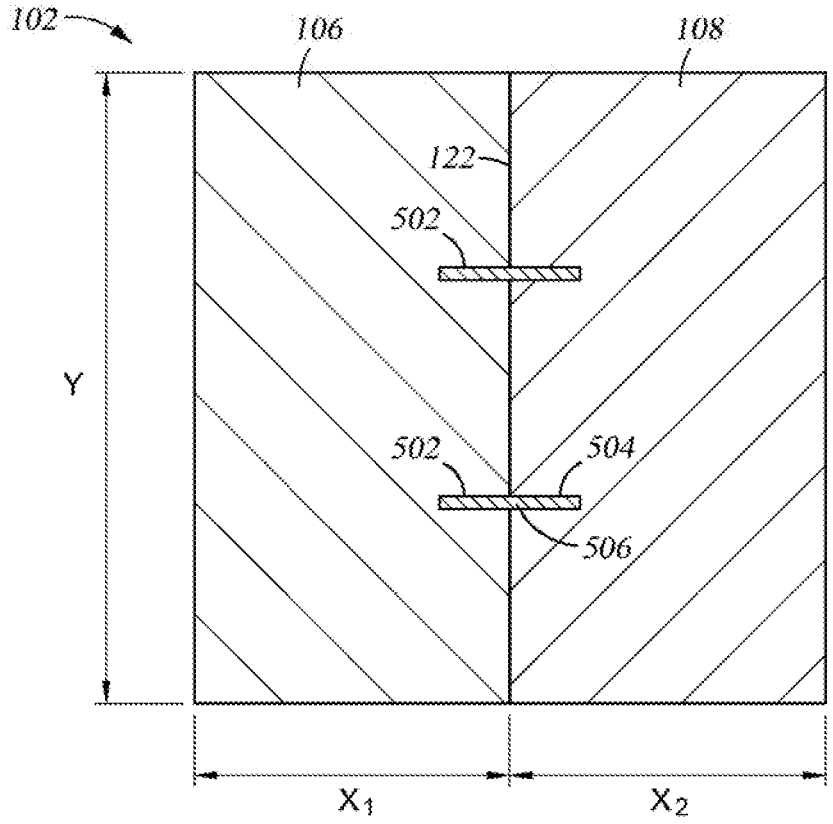
FIG. 5 is a top view of a portion of the tank lid of FIG. 1 showing attachment straps.

In one or more exemplary embodiments, a strap with any suitable clasping means, such as a cam buckle, can be used to secure the segments 106, 108, 110 together. FIG. 5 is a top view of a portion of the tank lid 102 showing straps 502. Two straps 502 are shown though any suitable number of straps may be used to secure the segments 106, 108. Each strap 502 can include an anchor portion 504 (two are shown for each strap 502) and a clasp portion 506. The anchor portion 504 can be attached or otherwise connected to segments 106, 108 by any suitable means, such as coating the strap 502 and substrate together with the elastomeric coating such that the anchor portion 504 of the strap 502 is fixably disposed or sandwiched between the elastomeric coating and the substrate. The straps 502 can attached to the segments in any suitable arrangement. For example, the straps 502 can be arranged perpendicular to the seam 122 (as shown in FIG. 5) or the straps 502 can be arranged at any position diagonally offset relative to the seam 122.

Figure 6:
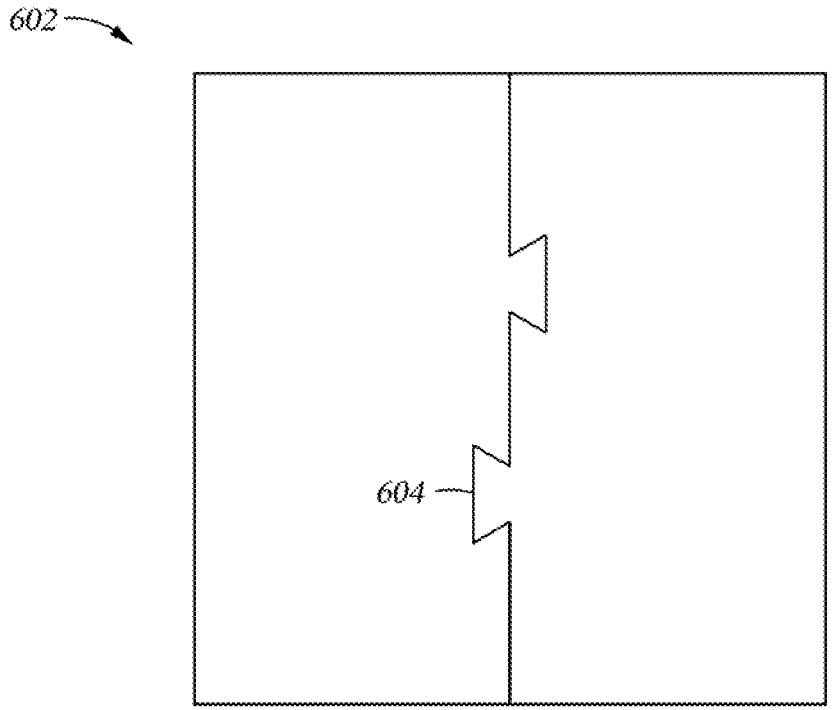
FIG. 6 is a top view of a portion of another tank lid, according to an exemplary embodiment.

In one or more exemplary embodiments, the segments 106, 108, 110 can contain protrusions and corresponding recesses to form interlocking seams connecting adjacent segments together. FIG. 6 is a top view of a portion of a tank lid 602 showing an interlocking seam 604 having protrusions and corresponding recesses.

Figure 7:
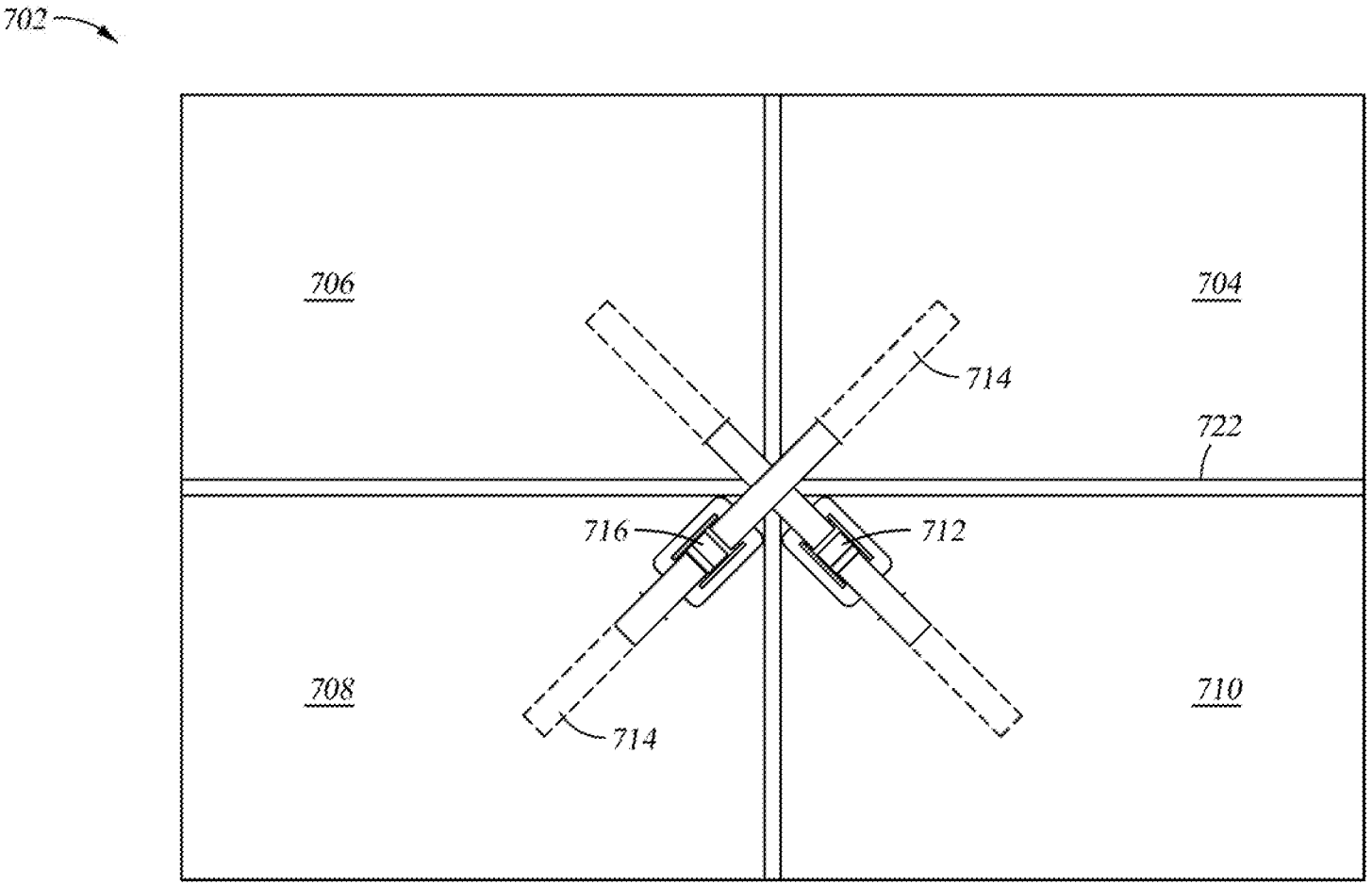
FIG. 7 is a top view of a portion of yet another tank lid, according to an exemplary embodiment.
Figure 8:
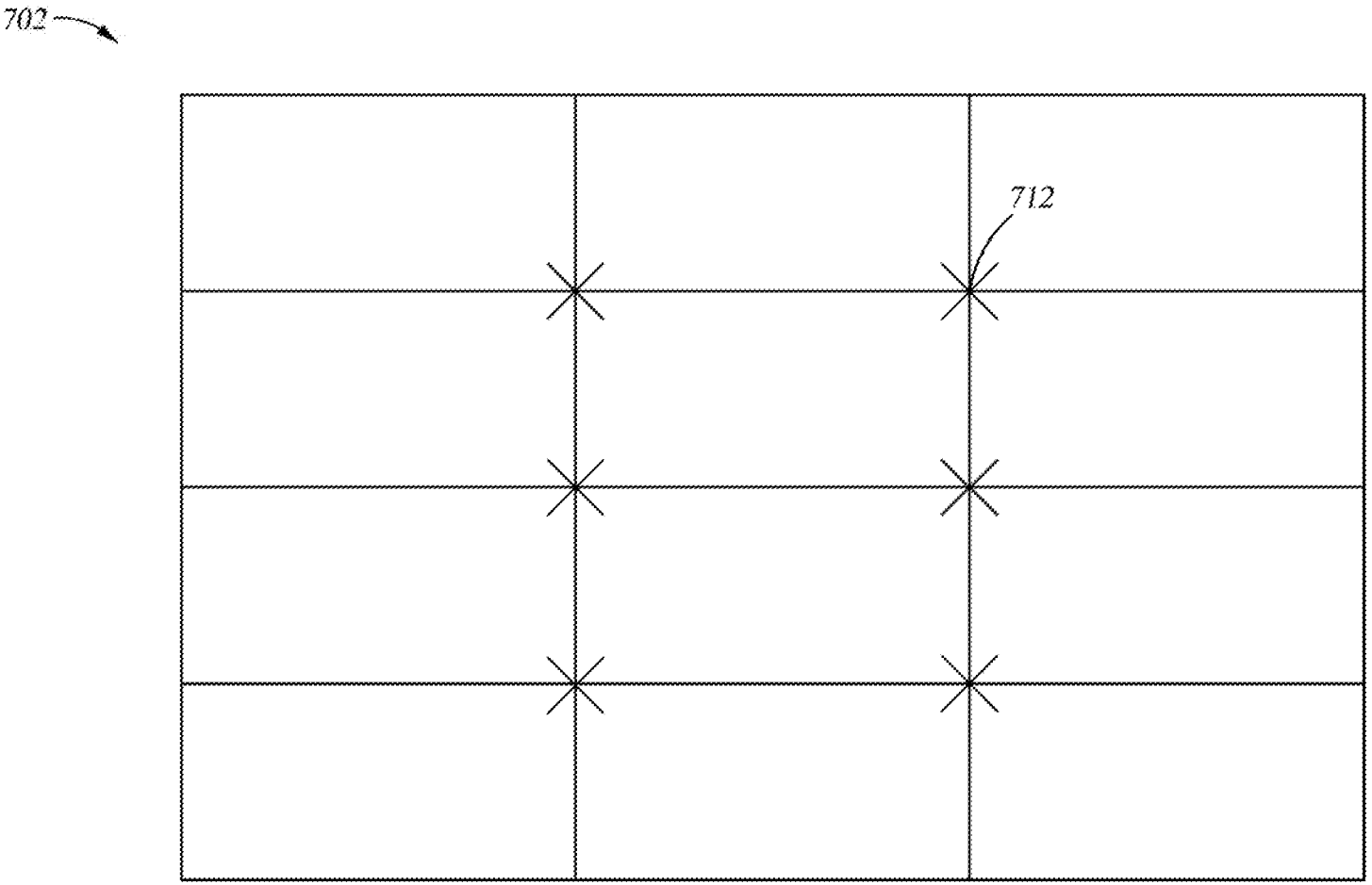
FIG. 8 is a top view of the tank lid of FIG. 7.

In one or more exemplary embodiments, the segments can be attached or otherwise connected to each other at their respective corners such that the straps are arranged at a position that is diagonally offset relative to the seam. FIG. 7 is a top view of a portion of a tank lid 702 having segments 704, 706, 708, 710 that are attached or otherwise connected to each other via straps 712 (two are shown, forming an X-shaped pattern). Each strap 712 can include an anchor portion 714 (two are shown for each strap 712) and a clasp portion 716. The anchor portion 714 can be attached or otherwise connected to segments 704, 706, 708, 710 by any suitable means, such as coating the strap 712 and substrate together with the elastomeric coating such that the anchor portion 714 of the strap 712 is fixably disposed or sandwiched between the elastomeric coating and the substrate. The straps 712 can attached to the segments in any suitable arrangement. For example, the straps 712 can be arranged at any position diagonally offset relative to the seam 722. In one or more exemplary embodiments, the straps 712 are disposed at a position that is from about 30 degrees to about 60 degrees, about 40 degrees to about 50 degrees, or about 45 degrees from perpendicular to the seam 722. FIG. 8 illustrates a top view of the complete tank lid 700.

An exemplary method for constructing the tank lid can include spraying an elastomeric coating onto the substrates to form the segments disclosed herein. The anchor portions 504, 714 of the straps 502, 712 can be positioned on the substrate followed by applying the elastomeric coating such that the anchor portions 504, 714 of the straps 502, 712 are fixably disposed or sandwiched between the elastomeric coating and the substrate, thereby forming the segments 106, 108, 110, 704, 706, 708 710. The segments can then be positioned adjacent to one another and connected to each other via the straps 502, 712 to form the tank lid.

Though particular shapes of tank lids, its segments and other component parts are disclosed herein, the tank lid can include any suitable configuration, size, and shape. For example, the tank lid can have a triangular, square, rectangular, circular, oval, hexagonal, or octagonal footprint and can be from about 1 foot to about 50 feet or more in its largest dimension, such as from about 2 feet to about 20 feet, such as from about 3 feet to about 12 feet, such as from about 4 feet to about 8 feet, for example about 6 feet. In several exemplary embodiments, the tank lid has a square or rectangular footprint, and ranges from about 1 m to about 30 m in length, and from about 1 m to about 30 m in width.

In several exemplary embodiments, the tank lids disclosed herein can cover any suitable portion of the water surface 112 of the volume of water 103 in the water tank 101. In one or more exemplary embodiments, the tank lid 102 can cover at least about 10%, at least about 15%, at least about 20%, at least about 30%, at least about 40%, or at least about 50% water surface 112. In one or more exemplary embodiments, the tank lid 102 can cover less than 100%, less than 99%, less than 95%, less than 90%, less than 85%, less than 80%, less than 75%, less than 65%, less than 50%, less than 40%, or less than 35% of the water surface 112. In one or more exemplary embodiments, about 25%, about 30%, about 35%, or about 45% to about 55%, about 65%, about 75%, about 85%, about 90%, about 95%, or about 99% or more of the water surface 112 can be covered by the tank lid 102. For example, the tank lid 102 can have a footprint having a total surface area from about 90% to about 99%, from about 92% to about 98%, or from about 93% to about 97% of the total surface area of the surface area of the water surface 112.

In one or more exemplary embodiments, the tank lids disclosed herein can have a footprint that is smaller than a footprint of an interior space of a tank. In one or more exemplary embodiments, the tank lid 102 can have a footprint having a total surface area less than 100%, less than 99%, less than 95%, less than 90%, less than 85%, less than 80%, less than 75%, less than 65%, less than 50%, less than 40%, or less than 35% of the total surface area of the footprint of the interior space of tank 101. In one or more exemplary embodiments, the tank lid 102 can have a footprint having a total surface area from about 90% to about 99%, from about 92% to about 98%, or from about 93% to about 97% of the total surface area of the footprint of the interior space of tank 101.

In one more exemplary embodiments, the tank lid 102 can be in simultaneous contact with 3 or fewer of the plurality of sides 114, 116, 118, 120. For example, the tank lid 102 can be in simultaneous contact with sides 114 and 116, 116 and 118, 118 and 120, or 120 and 114. In one more exemplary embodiments, the tank lid 102 is in simultaneous contact with no more than two of the plurality of sides 114, 116, 118, 120. In one more exemplary embodiments, the tank lid 102 can only simultaneously contact sides 114 and 116, 116 and 118, 118 and 120, or 120 and 114.

Any spatial references such as, for example, "upper," "lower," "above," "below," "between," "bottom," "vertical," "horizontal," "angular," "upward," "downward," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. A floating lid sized for an open-top water containment system, comprising:

a first coated substrate, comprising:
- a first part having a first thickness;
- a first elastomer coating the first part; and
- a first planar portion;

a second coated substrate configured to be positioned adjacent to the first coated substrate, the second coated substrate comprising:
- a second part having a second thickness;
- a second elastomer coating the second part; and
- a second planar portion;

wherein the first and second planar portions are coplanar when the second substrate is positioned adjacent to the first coated substrate and perpendicular to each of the respective first and second thicknesses of the first and second parts; and a first seam formed between the first and second coated substrates to allow for moisture to pass between the first and second coated substrates, wherein the first and second coated substrates are in direct contact with each other.

2. The floating lid of claim 1, wherein the first and second coated substrates are encapsulated by the first and second elastomer, respectively, to provide first and second encapsulated substrates.

3. The floating lid of claim 2, wherein the first and second coated substrates each have an R-Value, measured in accordance with ASTM C518, of about 2° F.ft$^2$h/Btu to about 10° F.ft$^2$h/Btu.

4. The floating lid of claim 2, wherein the first and second encapsulated substrates are shaped so that the first seam is interlocking.

5. The floating lid of claim 2, wherein the tank further comprises a strap connecting the first and second encapsulated substrates together.

6. The floating lid of claim 1, wherein the first and second substrates comprise first and second edges, respectively; and wherein the second edge interfits with the first edge to at least partially form the first seam.

7. The floating lid of claim 1, wherein the first part and the second part comprise a foam material.

8. The floating lid of claim 7, wherein the foam material has a density of at least about 1.0 pounds per cubic foot.

9. The floating lid of claim 7, wherein the foam material comprises expanded polystyrene.

10. The floating lid of claim 1, wherein the first elastomer and the second elastomer comprise polyurea.

11. The floating lid of claim 1, wherein the first elastomer and the second elastomer each have a thickness of at least about 50 mils.

12. The floating lid of claim 1, wherein the first thickness and the second thickness are each at least about 2 inches.

13. An open-top water containment system, comprising:

a tank comprising a bottom and four sides extending vertically from the bottom defining an interior space;

a volume of water having an upper surface contained within the tank;

a lid floating on the upper surface of the water, the lid comprising:

a first coated substrate, comprising:
- a first part having a first thickness;
- a first elastomer coating the first part; and
- a first planar portion;

a second coated substrate configured to be positioned adjacent to the first coated substrate, the second coated substrate comprising:
- a second part having a second thickness;
- a second elastomer coating the second part; and
- a second planar portion;

wherein the first and second planar portions are coplanar when the second substrate is positioned adjacent to the first coated substrate and perpendicular to each of the respective first and second thicknesses of the first and second parts; and a first seam formed between the first and second coated substrates to allow for moisture to pass between the first and second coated substrates, wherein the first and second coated substrates are in direct contact with each other.

14. The containment system of claim 13, wherein the lid has a footprint having a total surface area from about 90% to about 99% of a total surface area of a footprint of the interior space of the tank.

15. The containment system of claim 13, wherein the first and second coated substrates are encapsulated by the first and second elastomer, respectively, to provide first and second encapsulated substrates.

16. The containment system of claim 15, wherein the first and second coated substrates each have an R-Value, measured in accordance with ASTM C518, of about 2° $F.ft^2h/Btu$ to about 10° $F.ft^2h/Btu$.

17. The containment system of claim 15, wherein the tank further comprises a strap connecting the first and second encapsulated substrates together.

18. The containment system of claim 13, wherein the first part and the second part comprise expanded polystyrene.

19. The containment system of claim 13, wherein the first elastomer and the second elastomer comprise polyurea.

20. An open-top water containment system, comprising:

a tank comprising a bottom and four sides extending vertically from the bottom defining an interior space;

a volume of water having an upper surface contained within the tank;

a lid floating on the upper surface of the water, the lid comprising:

a first coated substrate, comprising:

a first part having a first thickness;

a first elastomer coating the first part; and a first planar portion;

a second coated substrate configured to be positioned adjacent to the first coated substrate, the second coated substrate comprising:

a second part having a second thickness;

a second elastomer coating the second part; and a second planar portion;

wherein the first and second planar portions are coplanar when the second substrate is positioned adjacent to the first coated substrate and perpendicular to each of the respective first and second thicknesses of the first and second parts; and a first seam formed between the first and second coated substrates to allow for moisture to pass between the first and second coated substrates, wherein the first and second coated substrates are in direct contact with each other, and wherein the first coated substrate is in contact with at least one side and the lid is in simultaneous contact with no more than two of the four sides.

* * * * *